US005868551A

United States Patent [19]

Smiley, III et al.

[11] Patent Number: 5,868,551

[45] Date of Patent: Feb. 9, 1999

[54] TANGENTIAL FAN CUTOFF

[75] Inventors: William A. Smiley, III, La Crosse; William B. Rockwood, Onalaska, both of Wis.

[73] Assignee: American Standard Inc., Piscataway, N.J.

[21] Appl. No.: 850,172

[22] Filed: May 2, 1997

[51] Int. Cl.[6] ..... F04D 5/00

[52] U.S. Cl. ..... 415/53.1; 415/119

[58] Field of Search ..... 415/53.1, 53.2, 415/53.3, 119, 203, 204, 206, 211.1, 212.1

[56] References Cited

U.S. PATENT DOCUMENTS

| | | | |
|---|---|---|---|
| 2,171,341 | 8/1939 | McMahan | 415/119 |
| 3,286,914 | 11/1966 | Baverstock | 415/119 |
| 3,976,393 | 8/1976 | Larson | 415/119 |
| 4,182,596 | 1/1980 | Wellman . | |
| 4,712,976 | 12/1987 | Hopfensperger et al. . | |
| 4,714,408 | 12/1987 | Abe . | |
| 5,110,258 | 5/1992 | Morinushi et al. . | |
| 5,120,193 | 6/1992 | Kadle et al. . | |
| 5,279,515 | 1/1994 | Moore et al. . | |
| 5,449,271 | 9/1995 | Bushnell et al. . | |

FOREIGN PATENT DOCUMENTS

| | | | |
|---|---|---|---|
| 54-122415 | 9/1979 | Japan | 415/119 |
| 61-277894 | 12/1986 | Japan | 415/119 |
| 64-87900 | 3/1989 | Japan | 415/211.1 |
| 1657754 | 6/1991 | U.S.S.R. | 415/119 |

*Primary Examiner*—Christopher Verdier
*Attorney, Agent, or Firm*—William J. Beres; William O'Driscoll; Peter D. Ferguson

[57] ABSTRACT

A fan assembly. The fan assembly comprises: a fan having an axis and an outer periphery; a housing about the fan; and a cutoff separating fan inflow from fan outflow. The cutoff is preferably arranged parallel to the axis and is proximal to the outer periphery. The cutoff includes first and second layers. The first layer provides structural support and has a plurality of apertures therethrough. The second layer is formed of an acoustically insulating material.

8 Claims, 4 Drawing Sheets

TANGENTIAL FAN CUTOFF

BACKGROUND OF THE INVENTION

The present invention is directed to tangential fan cutoff designs that reduce blade passing, frequency tonal sound levels.

In a typical arrangement having a tangential fan wheel, a scroll housing and a cutoff, the cutoff gap between the cutoff and the fan wheel is a critical dimension relative to the fan's airflow performance capability. Smaller fan cutoff gaps yield higher airflow, while larger fan cutoff gaps yield lower airflow. However, for traditional cutoff designs such as the design shown in FIG. 1, optimum airflow performance arrangements having a smaller cutoff gap also result in a significant and objectionable blade tone. The acoustic strength of the blade tone is a function of the blade spacing, the cutoff gap size, the scroll shape, and the cutoff design. The blade tone can be reduced by increasing the cutoff gap spacing, but at the cost of reduced airflow performance. An optimum spacing of the fan cutoff gap is shown by the formula G=KD where G is the cutoff gap size, D is the fan wheel diameter, and K ranges between 0.038 and 0.055.

Another method of reducing the blade tone is to increase the number of fan blades. However, this increases fan cost and reduces airflow performance due to the increased number of blades blocking the fan flow passage.

SUMMARY OF THE INVENTION

It is an object, feature and an advantage of the present invention to solve the problems in the prior art.

In the present invention, the blade tone is reduced while maintaining the higher airflow without increasing either the number of fan blades or the size of the cutoff gap. This is accomplished using the novel fan cutoff designs shown in FIGS. 2 and 5.

A first preferred embodiment of an improved cutoff design is shown in FIG. 2. The cutoff of FIG. 2 is similar to traditional designs with the exception that the material of the cutoff is perforated, and insulating material is added. The effect of the perforated material is to roughen the cutoff surface and thereby promote the breaking up of the fan's discharge vortex sheet locally at the fan cutoff surface. This disrupts the formation and interaction between the flow velocity and the acoustic mechanism creating the blade tone. The surface of the cutoff further acts as a miniature local resonator or acoustic capacitor to absorb and cancel discrete noise. The addition of insulation prevents airflow from freely passing through the perforated material and recirculating from the high pressure discharge side of the fan to the low pressure inlet side of the fan. Such recirculation would have the effect of reducing the effective airflow performance of the assembly. A secondary benefit of the insulating material is to absorb a portion of the broad band acoustic energy and lower the overall broad band acoustical level.

A second preferred embodiment of a cutoff design that minimizes the blade tone is shown in FIG. 5. This design consists of a "patterned" leading edge such as a "sawtooth" leading edge, rather than the more traditional unpatterned curved or straight edge. The design of the sawtooth leading edge, including its pitch P and height H, are critical to the effect of this. The optimum geometry of the sawtooth height H is reflected by the formula $H=\alpha D$ where $0.04<\alpha<0.06$. The optimum geometry of the sawtooth pitch P is reflected by the formula $P=\beta D$ where $0.06<\beta<0.11$. (D is the fan wheel diameter). The pattern may be a sawtooth edge, a serrate edge, a corrugaated edge, a sinusoidal wave edge, a square wave edge, or any combination thereof.

The cutoff design of FIG. 5 can also be made of perforated material with or without sound absorbing insulation, such as is shown in FIG. 12. The effect of the sawtooth leading edge is similar to the other cutoff in breaking up the local velocity acoustical interaction creating the blade tone. With the new cutoff design, the cutoff gap can be maintained to give optimum airflow performance without generating an objectionable blade tone.

The present invention provides a fan assembly comprising a fan having an axis and an outer periphery; a housing about the fan; and a cutoff separating fan inflow from fan outflow. The cutoff is preferably arranged parallel to the axis and is proximal to the outer periphery. The cutoff includes first and second layers, the first layer providing structural support and having a plurality of apertures therethrough, and the second layer being formed of an acoustically insulating material.

The present invention also provides a fan assembly comprising: a fan having an axis and an outer periphery; a housing about the fan; and a cutoff separating fan inflow from fan outflow. The cutoff is preferably arranged parallel to the axis and is proximal to the outer periphery at a first cutoff edge. The first cutoff edge is parallel to the axis and has a patterned feature.

The present invention further provides a fan cutoff comprising a first layer having a J-shape including a first curved edge and a generally planar section; and a second acoustically insulating layer contiguous to the first layer and nestled inside the J. The first layer includes a plurality of apertures exposing the underlying insulating layer.

The present invention additionally provides a fan assembly comprising a fan having an axis and an outer periphery; a housing about the fan; and a cutoff separating fan inflow from outflow. The cutoff is arranged parallel to the axis and is proximal to the outer periphery. The cutoff is formed of an acoustically insulating material and preferably has a first edge parallel to and proximal the outer periphery. The first edge includes a patterned feature, and the cutoff having a surface with perforations or apertures therethrough.

DETAILED DESCRIPTION OF THE DRAWINGS

Figure 1:
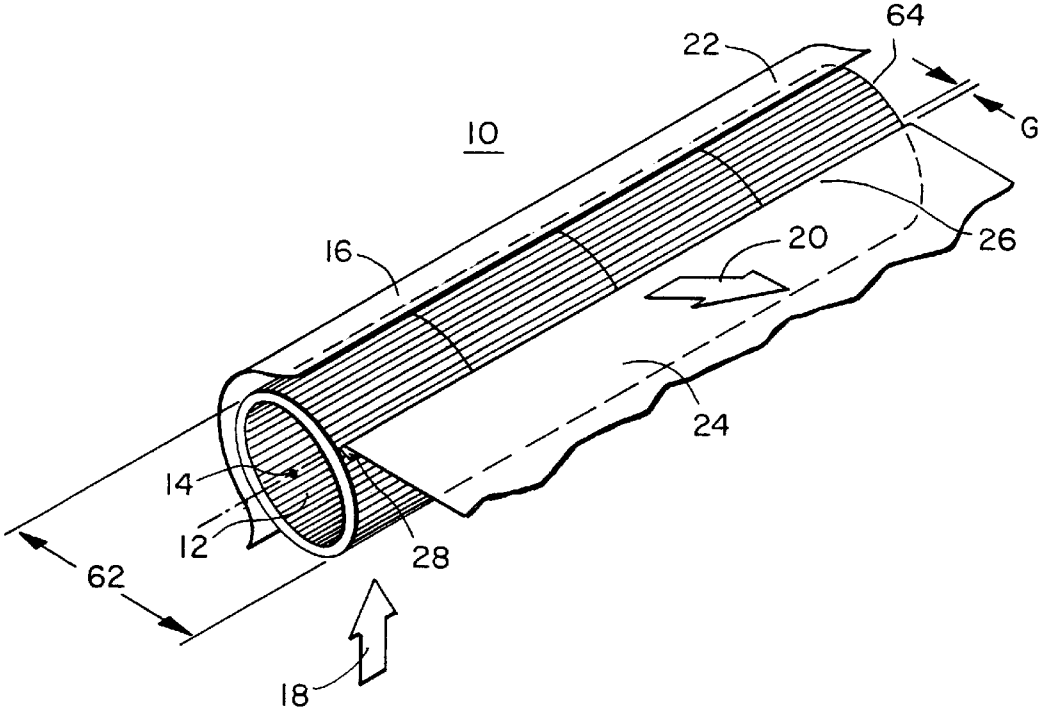
FIG. 1 (PRIOR ART)
FIG. 1 shows a prior art fan assembly including a tangential fan, a fan scroll housing, and a fan cutoff.

FIG. 1 shows a tangential fan assembly 10 including a tangential fan 12 having an axially extending axis 14. A scroll housing 16 separates entering air 18 from discharge air 20 and also includes an expanding scroll section 22 for diffusing the discharge air 20. The scroll housing 16 is typically on one side of the tangential fan 12 and a fan cutoff 24 is provided on an opposing side of the tangential fan 12. The fan cutoff 24 includes a first end 26 which is proximal the tangential fan 12 and also acts to separate discharge air 20 from entering air 18. The fan cutoff 24 may have a J-shape wherein the curve 28 of the J-shape is located at the first edge and arcs toward the entering air 18. In other cases, the first end 26 may be implemented as a straight edge (not shown). The distance between the first edge 26 and the outer periphery of the tangential fan 12 is a cutoff gap G.

Figure 2:
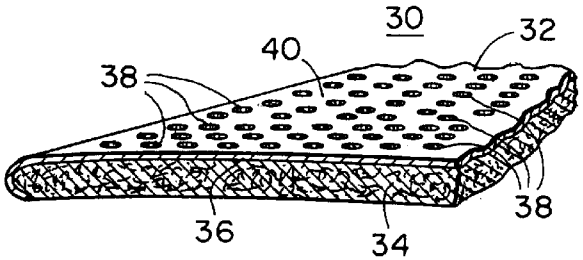
FIG. 2 shows a first preferred embodiment of the present invention where the fan cutoff of FIG. 1 has been modified.

FIG. 2 reflects a first preferred embodiment of the present invention wherein the fan cutoff 24 of FIG. 1 is modified in several ways to form a new cutoff 30. The cutoff 30 of the first preferred embodiment includes a first rigid layer 32 which is preferably metallic and preferably in a J-shape similar to that of the fan cutoff 24. The cutoff 30 includes a second layer 34 formed from an acoustically insulating material such as fiberglass and affixed to the first layer 32 on a side 36 of the first layer 32 towards the entering air 18 such that the second layer 34 is nestled within the J-shape. The first layer 32 includes a plurality of perforations 38 distributed over the surface 40 of the first layer 32. These perforations 38 are of any shape and size and may be of varying shapes and sizes but are preferably similarly sized circular apertures since such apertures are easily manufacturable. The perforations 38 preferably completely penetrate the first layer 32 so as to expose the acoustically insulating material of the underlying second layer 34. When installed such that the discharge air 20 of a tangential fan 12 flows along the surface 40, the acoustically insulating material of the second layer 34 has a sound damping affect on the discharge air 20 and the perforations 38 disrupt the interaction between the flow velocity and acoustic mechanism creating blade tone by creating turbulence.

Figure 3:
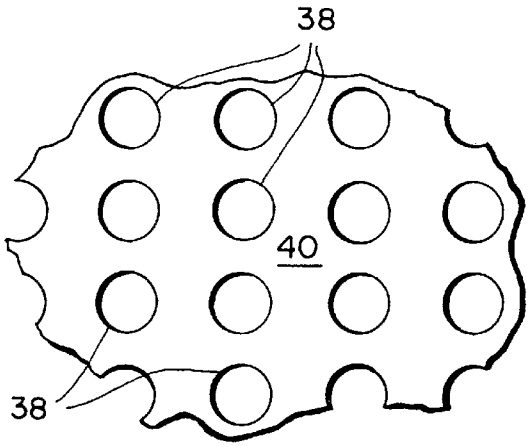
FIG. 3 shows a close-up of the surface of the first preferred embodiment.

FIG. 3 illustrates that the perforations 38 of FIG. 2 are preferably regularly sized circles of regular spacing.

Figure 4:
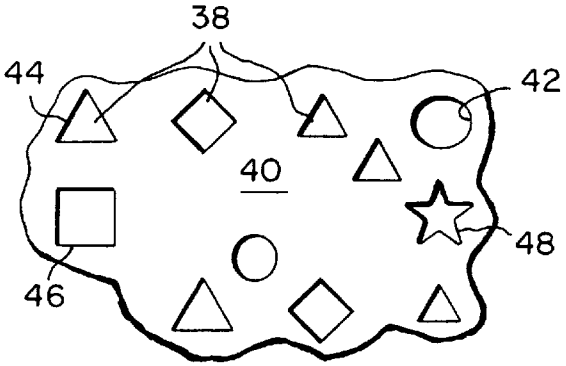
FIG. 4 shows a variation of FIG. 3.

FIG. 4 illustrates that the perforations 38 of FIG. 2 on the surface 30 may be circular 42, triangular 44, rectangular 46 or jagged apertures 48. FIG. 4 also illustrates that the similarly shaped apertures may be of varying sizes and that the spacing may be irregular. Other variations including raised louvers or ramps are contemplated.

Figure 5:
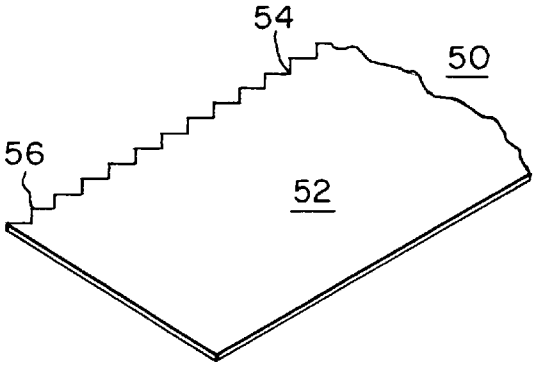
FIG. 5 shows a second preferred embodiment of the present invention where the fan cutoff of FIG. 1 has been modified.

FIG. 5 illustrates a second preferred embodiment of the present invention wherein the fan cutoff 24 of FIG. 1 is modified in several ways to form a new fan cutoff 50. The fan cutoff 50 is essentially a flat or planar surface 52 having an edge 54 located proximal the tangential fan 12 very much like the edge 26 is shown in FIG. 1. However, the edge 54 of the second preferred embodiment is patterned to disrupt turbulence with a patterned feature 56. This patterned feature 56 is shown in its preferred form in FIG. 6.

Figure 6:
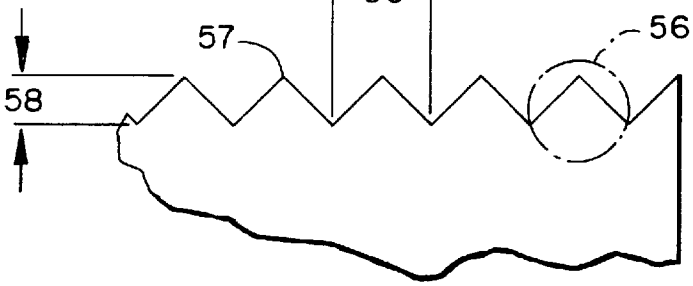
FIG. 6 shows a portion of FIG. 5.

FIG. 6 shows the patterned feature 56 as a sawtooth or serrate edge 57 having a height H shown by reference numeral 58 and a pitch P shown by reference numeral 60. The pitch P represents the distance until the pattern repeats, and the height H indicates the lowest to highest distance of the feature 56. The pitch and the height have a preferred relationship with the fan diameter D (reference numeral 62) of the tangential fan 12. The height H is optimally a function of the formula:

$$H=\alpha D \text{ where } 0.04<\alpha<0.06 \quad (1)$$

The pitch is optimally a function of the formula:

$$P=\beta D \text{ where } 0.06<\beta<0.11 \quad (2)$$

The features 56 can be arranged either in a planar manner to point at the axis 14 or arranged in a raised manner so as to be pointing tangent to the outer periphery 64 of the tangential fan 12. In the preferred embodiment of FIG. 5, the surface 52 is essentially flat, planar and featureless.

Figure 7:
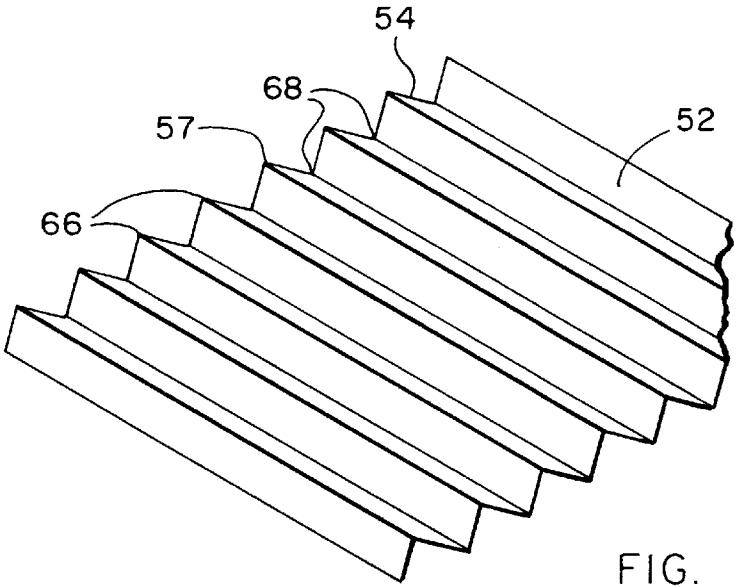
FIG. 7 is a variation of FIG. 5.

FIG. 7 illustrates that the surface 52, when implemented as the sawtooth of FIG. 6, may be completely corrugated such that peaks and valleys 66, 68 commence at the edge 54 and extend across the surface 52 perpendicular to the axis 14.

Figure 8:
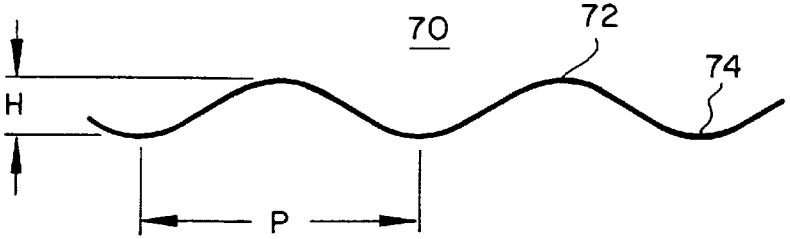
FIG. 8 shows a further variation of FIG. 5.

FIG. 8 illustrates a variation of FIG. 6 or 7 where, instead of a sawtooth, the patterned feature 56 is illustrated as a sinusoidal wave 70 having peaks 72 and valleys 74.

Figure 9:
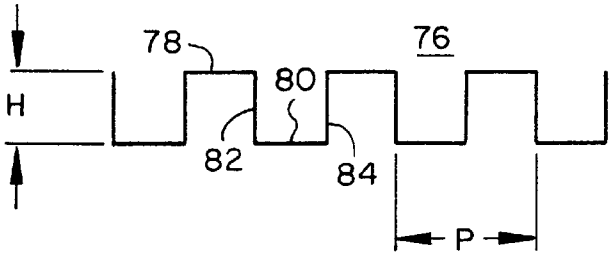
FIG. 9 shows yet another variation of FIG. 5.

FIG. 9 illustrates a variation of FIG. 6 wherein the sawtooth is replaced by a square wave 76 which regularly transitions from a first height 78 to a second height 80 with connection portions 82 and 84 therebetween.

Figure 10:
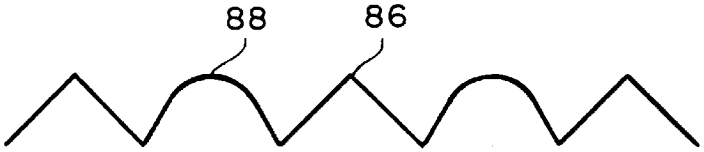
FIG. 10 shows a further variation of FIG. 5.

FIG. 10 illustrates that the sawtooth of FIG. 6 may be alternated with the sinusoidal wave of FIG. 8 such that each sawtooth 86 alternates with a sinusoidal wave 88.

Figure 11:
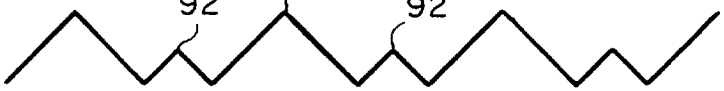
FIG. 11 shows yet another variation of FIG. 5.

FIG. 11 illustrates that different size sawtooths may be arranged in alternating or other order such that a large sawtooth 90 may be interposed between smaller sawtooths 92.

Figure 12:
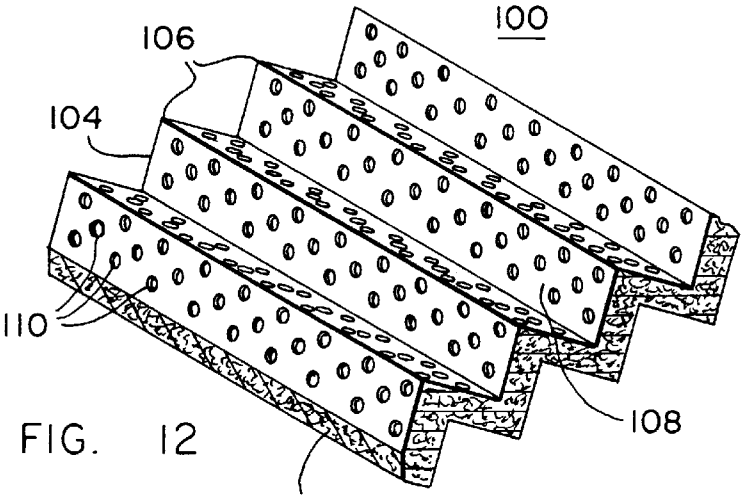
FIG. 12 shows a third embodiment of the present invention reflecting a combination of the first preferred embodiment of FIG. 2 and the second preferred embodiment of FIG. 5.

FIG. 12 is a third embodiment of the present invention reflecting a combination of the first and second preferred embodiments. In FIG. 12 the fan cutoff 24 of FIG. 1 is modified in several ways to form a new fan cutoff 100. This new fan cutoff 100 is formed from a rigid acoustically insulating material 102 having a edge 104 with patterned features 106 extending across the surface 108 of the cutoff 100 in a direction perpendicular to edge 104. The edge 104 is arranged proximal the tangential fan 12. Since the acoustically insulating material of the cutoff 100 is rigid, the first layer 32 of FIG. 2 is unnecessary. The cutoff 100 may include perforations 110.

Figure 13:
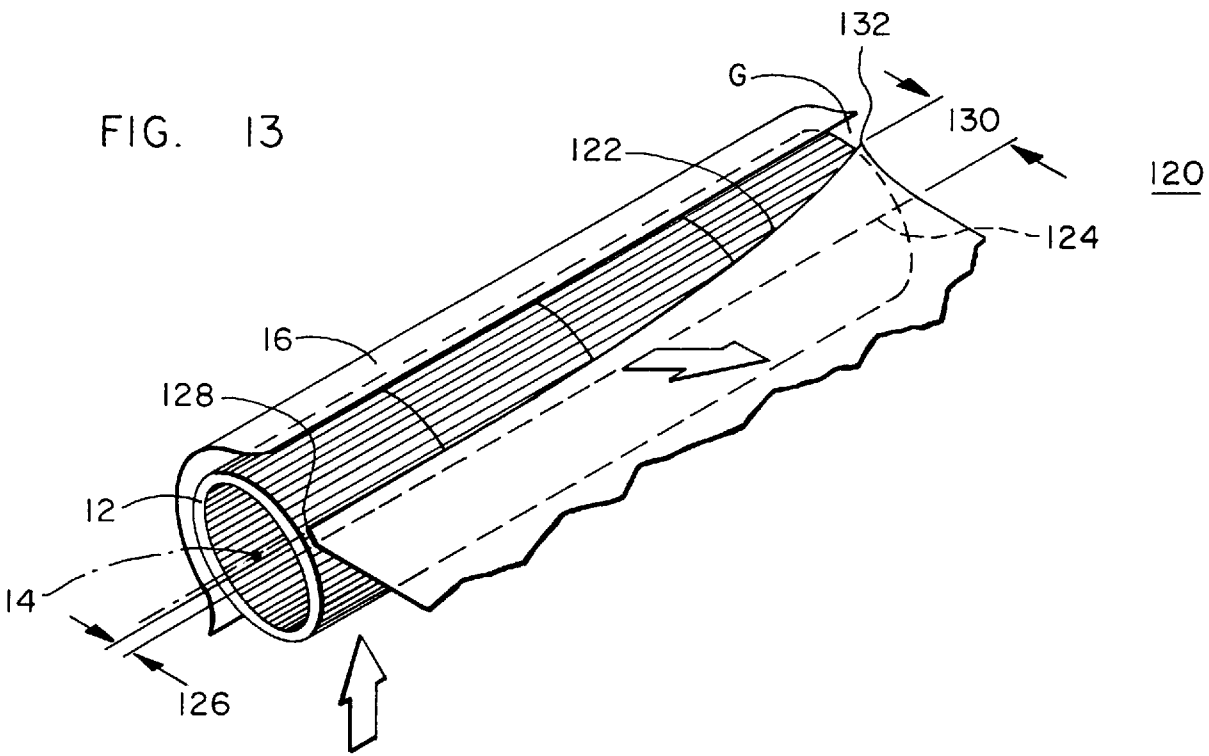
FIG. 13 shows a fourth embodiment of the present invention where the cutoff edge spirals around the fan rather than paralleling the fan axis.

FIG. 13 is a fourth embodiment of the present invention where the fan cutoff 24 of FIG. 1 is modified in several ways to form a new fan cutoff 120. This fan cutoff 120 has an edge 122 proximal the tangential fan 12 where the edge 122 does not parallel the fan axis 14 as did previous embodiments. Instead, the edge 122 is skewed relative to the axis 14 so that the edge spirals around the periphery of the tangential fan 12, preferably while maintaining a constant gap G between the fan 12 and the edge 122. For purposes of illustration, a line 124 is shown parallel to the fan axis 14. It can be seen that a distance 126 between the line 124 and a first end 128 of the edge 122 is smaller than a distance 130 between the line 124 and a second end 132 of the edge 122, this difference in distance reflecting the skewing or spiraling of the edge 22 around the periphery of the fan 12. The cutoff 120 may include either or both of the patterned feature element 56 or the layers 32, 34 as previously described with respect to the first, second and third embodiments.

Other modifications and alterations are readily apparent to a person skilled in the art. Those modifications include modifying FIG. 2 to a flat generally planar surface having a straight edge 26 where the surface 40 is perforated and where an acoustically insulating material is attached as a second layer on the entering air side of the first layer 32. Other modifications could include the addition of raised turbulence generating features such as ramps, louvers, or delta wings. All such alterations and modifications are contemplated to fall within the spirit and scope of the present invention.

What is claimed for Letters Patent of the United States if set forth in the following claims:

1. A fan assembly comprising:

a fan having an axis and an outer periphery;

a housing about the fan; and a cutoff separating fan inflow from fan outflow, the cutoff being arranged parallel to the axis and being proximal to the outer periphery at a first cutoff edge, the first cutoff edge having a patterned feature;

wherein the patterned feature has a pitch P and a height H which are related to the fan diameter D such that $H=\alpha D$ where $0.04<\alpha<0.06$ and $P=\beta D$ where $0.06<\beta<0.11$.

2. The fan assembly of claim 1 wherein the patterned feature is a sawtooth edge, a serrate edge, a corrugated edge, a sinusoidal wave edge, a square wave edge, or any combination thereof.

3. The fan assembly of claim 1 wherein the cutoff edge is parallel to the axis.

4. The fan assembly of claim 1 wherein the cutoff edge is skewed relative to the axis.

5. A fan assembly comprising:

a tangential fan extending in a radial direction and having entering air and discharge air;

a fan housing about the tangential fan separating the entering and discharge air and directing the discharge air;

a fan cutoff generally extending in the axial direction and arranged to have a first fan cutoff edge proximal the tangential fan to prevent backflow of the discharge air to the entering air, the cutoff being generally planar and the first edge being formed with a performance enhancing pattern; and wherein the performance enhancing feature has a pitch P and a height H and the tangential fan has a diameter D such that $H=\alpha D$ where $0.04<\alpha<0.06$ and $P=\beta D$ where $0.06<\beta<0.11$.

6. The fan assembly of claim 5 wherein the performance enhancing pattern is corrugated, sinusoidal, a patterned edge, a sawtooth form or a rectangular wave form.

7. The fan assembly of claim 5 wherein the cutoff edge is parallel to the axial direction.

8. The fan assembly of claim 5 wherein the cutoff edge is skewed relative to the axial direction.

* * * * *

UNITED STATES PATENT AND TRADEMARK OFFICE

CERTIFICATE OF CORRECTION

PATENT NO. : 5,868,551

DATED : February 9, 1999

INVENTOR(S) : William A. Smiley, III and William B. Rockwood

It is certified that error appears in the above-identified patent and that said Letters Patent is hereby corrected as shown below:

On the title page,

[57]Abstract:

Line 8, add --The cutoff also includes a "patterned" leading edge such as a "sawtooth" leading edge.--

Signed and Sealed this

Sixth Day of July, 1999

Attest:

Q. TODD DICKINSON

Attesting Officer

Acting Commissioner of Patents and Trademarks